US008491449B2

(12) United States Patent
Rogers et al.

(10) Patent No.: US 8,491,449 B2
(45) Date of Patent: Jul. 23, 2013

(54) WEIGHTLIFTING SYSTEM

(75) Inventors: Orley David Rogers, Sanford, MI (US); Kenneth Edward Staten, Clare, MI (US)

(73) Assignee: Rogers Athletic Company, Clare, MI (US)

( * ) Notice: Subject to any disclaimer, the term of this patent is extended or adjusted under 35 U.S.C. 154(b) by 0 days.

(21) Appl. No.: 13/551,805

(22) Filed: Jul. 18, 2012

(65) Prior Publication Data

US 2012/0283075 A1 Nov. 8, 2012

Related U.S. Application Data

(60) Continuation of application No. 13/409,428, filed on Mar. 1, 2012, now Pat. No. 8,257,233, which is a continuation of application No. 13/026,570, filed on Feb. 14, 2011, now Pat. No. 8,147,390, which is a division of application No. 11/326,095, filed on Jan. 5, 2006, now Pat. No. 7,918,771.

(51) Int. Cl.
*A63B 21/078* (2006.01)
*A63B 21/08* (2006.01)

(52) U.S. Cl.
USPC ..... 482/100; 482/97

(58) Field of Classification Search
USPC ..... 482/14–17, 23, 35–36, 38–42, 92–94, 482/97–101, 104, 133–138, 142; 312/265.1–265.4; 211/85.7, 187, 192; 248/220.21, 220.23, 220.41–220.43, 221.11; 428/134; 108/107, 147.12, 147.14–147.15; 403/263, 353; D21/662, 673, 675, 686, 691, D21/694

IPC ..... A63B 21/078,21/08
See application file for complete search history.

(56) References Cited

U.S. PATENT DOCUMENTS

| | | | |
|---|---|---|---|
| 3,844,416 | A | 10/1974 | Potter |
| 4,369,966 | A | 1/1983 | Silberman et al. |
| 4,753,126 | A | 6/1988 | Sammaratano |
| 4,842,270 | A | 6/1989 | Lange |
| 4,861,024 | A | 8/1989 | Lee |
| 5,215,510 | A | 6/1993 | Baran |
| 5,308,031 | A | 5/1994 | Evenson |
| 5,669,859 | A | 9/1997 | Liggett et al. |
| 5,788,614 | A | 8/1998 | Simonson |
| 6,205,934 | B1 | 3/2001 | Felton et al. |
| D444,827 | S | 7/2001 | Mobley |
| 6,482,139 | B1 | 11/2002 | Haag |
| 6,584,916 | B1 | 7/2003 | Felton et al. |
| 6,605,023 | B1 | 8/2003 | Mobley |
| 6,623,407 | B2 | 9/2003 | Novak et al. |
| 6,623,409 | B1 | 9/2003 | Abelbeck |
| 6,669,607 | B2 | 12/2003 | Slawinski et al. |

(Continued)

*Primary Examiner* — Oren Ginsberg
(74) *Attorney, Agent, or Firm* — Carlson, Gaskey & Olds P.C.

(57) ABSTRACT

A weightlifting system includes a weight bar frame rack having a first frame member that extends along a longitudinal axis. The first frame member includes a front face, a first side face, a second side face and a multiple of opposed pairs of openings disposed along the longitudinal axis. Each of the multiple of opposed pairs of openings are generally L-shaped and include a first opening and a second opening. A bracket assembly includes a mount having a first mount plate and a second mount plate spaced from the first mount plate. The first mount plate and the second mount plate are engageable relative to at least two opposed pairs of openings of the multiple of opposed pairs of openings.

15 Claims, 5 Drawing Sheets

U.S. PATENT DOCUMENTS

| | | | |
|---|---|---|---|
| 6,675,725 | B2 | 1/2004 | Felton et al. |
| 7,094,185 | B2 | 8/2006 | Greenland |
| 7,337,730 | B2 | 3/2008 | Bienick et al. |
| 7,338,416 | B2 | 3/2008 | Smith |
| 7,699,756 | B2 | 4/2010 | Piane, Jr. |
| 7,753,830 | B1 | 7/2010 | Marsh et al. |
| 7,918,771 | B2 | 4/2011 | Rogers et al. |
| 8,147,390 | B2 | 4/2012 | Rogers et al. |
| 2010/0227742 | A1 | 9/2010 | Jutte |

WEIGHTLIFTING SYSTEM

CROSS REFERENCE TO RELATED APPLICATIONS

This application is a continuation of U.S. patent application Ser. No. 13/409,428, filed Mar. 1, 2012, now U.S. Pat. No. 8,257,233 which is a continuation of U.S. patent application Ser. No. 13/026,570, filed Feb. 14, 2011, now U.S. Pat. No. 8,147,390 which is a divisional application of U.S. patent application Ser. No. 11/326,095, which was filed on Jan. 5, 2006 now U.S. Pat. No. 7,918,771.

BACKGROUND

This disclosure relates to a weightlifting system.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions. Oftentimes it is desirable to simulate the range of motion of free weights within a controlled environment. Most machines however are limited to a two dimensional plane of movement. Although effective, numerous machines are required as each machine is typically dedicated to only a few or a single exercise.

Machines are also relatively limited in the amount of weight which is contained within the machines stack of plates. As such, machines are undesirable for power lifting and for the training of powerful weightlifters who may find the stack of plates to be less than their capabilities.

SUMMARY

A weightlifting system includes a weight bar frame rack having a first frame member that extends along a longitudinal axis. The first frame member includes a front face, a first side face, a second side face and a multiple of opposed pairs of openings disposed along the longitudinal axis. Each of the multiple of opposed pairs of openings are generally L-shaped and include a first opening and a second opening. A bracket assembly includes a mount having a first mount plate and a second mount plate spaced from the first mount plate. The first mount plate and the second mount plate are engageable relative to at least two opposed pairs of openings of the multiple of opposed pairs of openings.

In another exemplary embodiment of the present disclosure, a weightlifting system includes a weight bar frame rack having a first frame member that extends along a longitudinal axis. The first frame member includes a front face, a first side face and a second side face. The first frame member has at least one opposed pair of openings disposed along the longitudinal axis, and each opening of the at least one opposed pair of openings is generally L-shaped. A bracket assembly includes a mount that straddles the first frame member to engage the at least one opposed pair of openings.

The various features and advantages of this disclosure will become apparent to those skilled in the art from the following detailed description. The drawings that accompany the detailed description can be briefly described as follows.

DETAILED DESCRIPTION

Figure 1A:
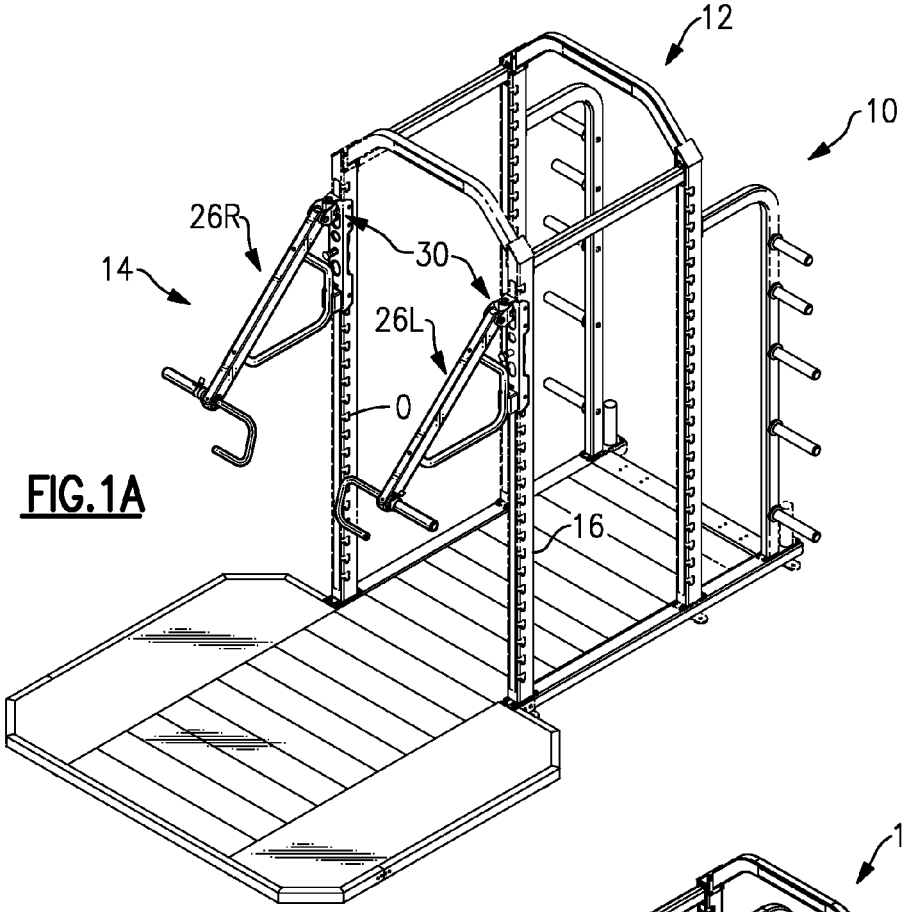
FIG. 1A is a perspective view of a weightlifting system with an incline arm system attached thereto.
Figure 1B:
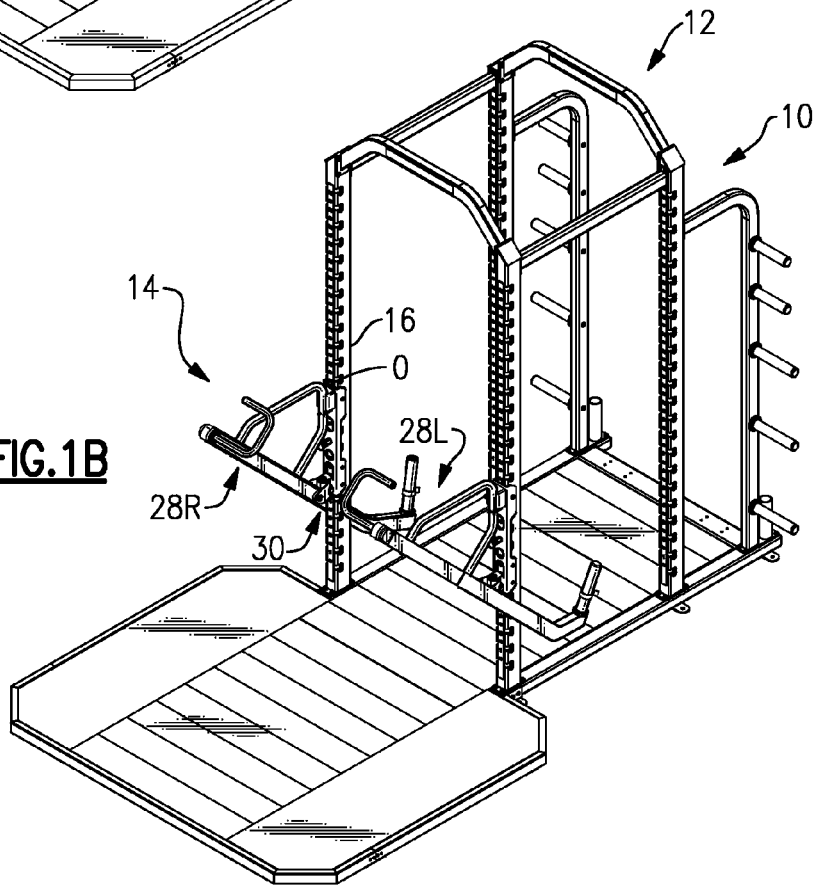
FIG. 1B is a weightlifting system with a decline arm system attached thereto.

FIG. 1A and 1B illustrates a perspective view of a weightlifting system 10 which includes a weight bar frame rack 12 for mounting a multitude of various weight arm systems 14. The frame rack 12 includes a multitude of openings O along an upright frame member 16 which receives the weight arm system 14 which may be located at various positions along the frame member 16. Each opening O is separated from the next by approximately four inches to provide significant incremental adjustment, however, any separation will be usable with the weightlifting system 10.

Figure 2:
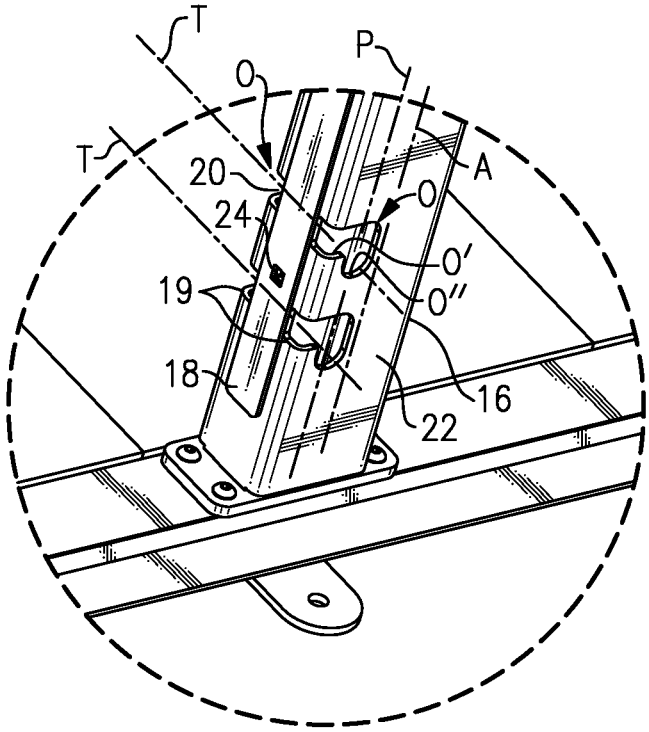
FIG. 2 is an expanded view of the weightlifting frame rack of FIGS. 1A and 1B.
Figure 3:
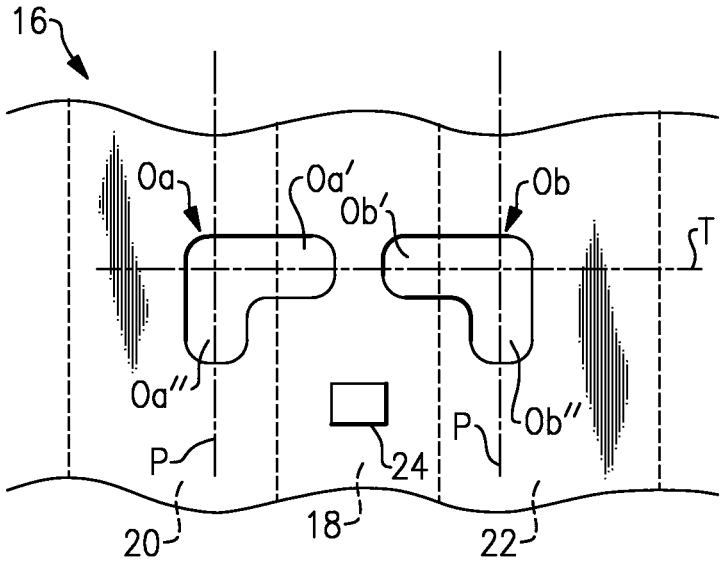
FIG. 3 is a schematic view of an opening in a weightlifting system frame rack upright.

Referring to FIGS. 2 and 3, each upright frame member 16 defines a longitudinal axis A which extends vertically relative to the ground. The upright frame member 16 is generally rectilinear in shape and can be manufactured of tubing which is rectangular in cross-section. The upright frame member 16 includes a front face 18 and a first and second side face 20, 22. The upright frame member 16 includes a multiple of opposed pairs of openings O along the longitudinal axis A, each of the opposed pairs of openings O including a first opening Oa and a second opening Ob.

Each opening Oa, Ob is generally L-shaped and spans the intersection of the front face 18 and one of the side faces 20, 22. In this non-limiting embodiment, the first opening Oa spans the front face 18 and the side face 20 and the second opening Ob spans the front face 18 and the side face 22. In other words, each opening O cuts through the corner of the upright frame member 16. Each opening O includes a first opening portion O' in the front face 18 generally transverse to the longitudinal axis A along a transverse opening axis T and a second opening portion O" through the respective side face 20, 22 generally parallel to the longitudinal axis A along a parallel opening axis P. In this non-limiting embodiment, the first opening Oa defines a first first opening portion Oa' through the front face 16 generally transverse to the longitudinal axis A along the transverse opening axis T and a second first opening portion Oa' through the first side face 20 generally parallel to the longitudinal axis A along the parallel axis P while the second opening Ob defines a first second opening portion Ob' through the front face 16 generally transverse to the longitudinal axis A and a second second opening portion Ob" through the second side face 22 generally parallel to the longitudinal axis A along the parallel axis P. That is, the first opening portions O' are along the axis T and opening portions O' and O" are generally perpendicular if laid flat (FIG. 3). Preferably, each opening O includes relatively large corner radiuses.

The openings O are arranged in horizontally opposed pairs of openings Oa, Ob perpendicular to the longitudinal axis A (best seen in FIG. 3). That is, each pair of openings O includes a first opening Oa located through the front face 18 and the first side face 20 and a second opening Ob located through the front face 18 and the second side face 22 such that the openings Oa, Ob are aligned when viewed from one of the side faces 20, 22 (best seen in FIG. 3).

A lock opening 24 is located through the front face 18 between each vertically separated pair of openings Oa, Ob. Each lock opening 24 is displaced parallel to the longitudinal axis A and is generally square in shape. It should be understood that other shapes are contemplated as within the scope of this disclosure. Preferably, the lock opening 24 is longitudinally staggered above each pair of openings Oa, Ob. For further understanding of other aspects of the rack system, attachment thereto and associated components thereof, attention is directed to U.S. patent application Ser. No. 11/326,099, filed Jan. 5, 2006 and entitled: WEIGHTLIFTING SUPPORT ASSEMBLY, which is assigned to the assignee of the instant disclosure and which is hereby incorporated herein in its entirety.

Figure 4A:
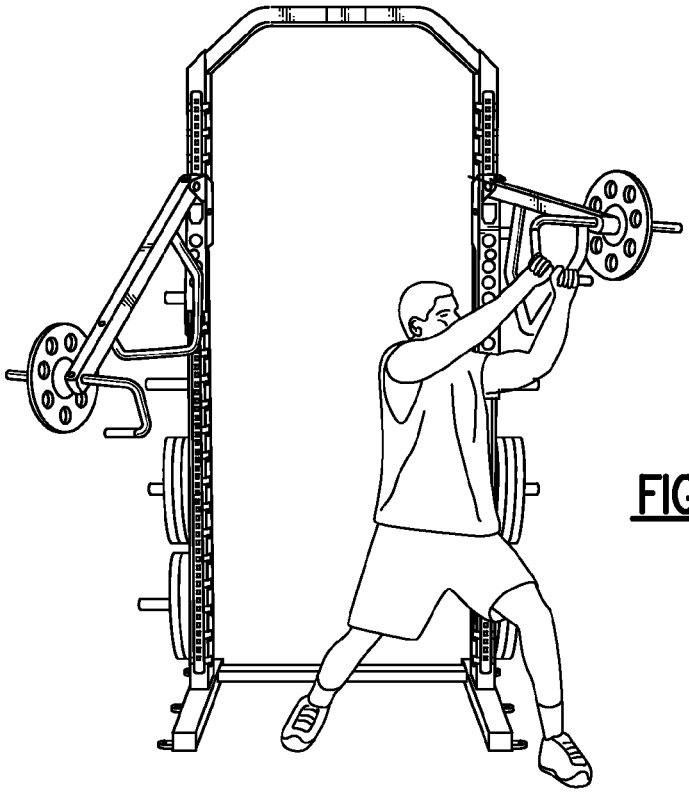
FIG. 4A is an example of the incline arm system in use.
Figure 4B:
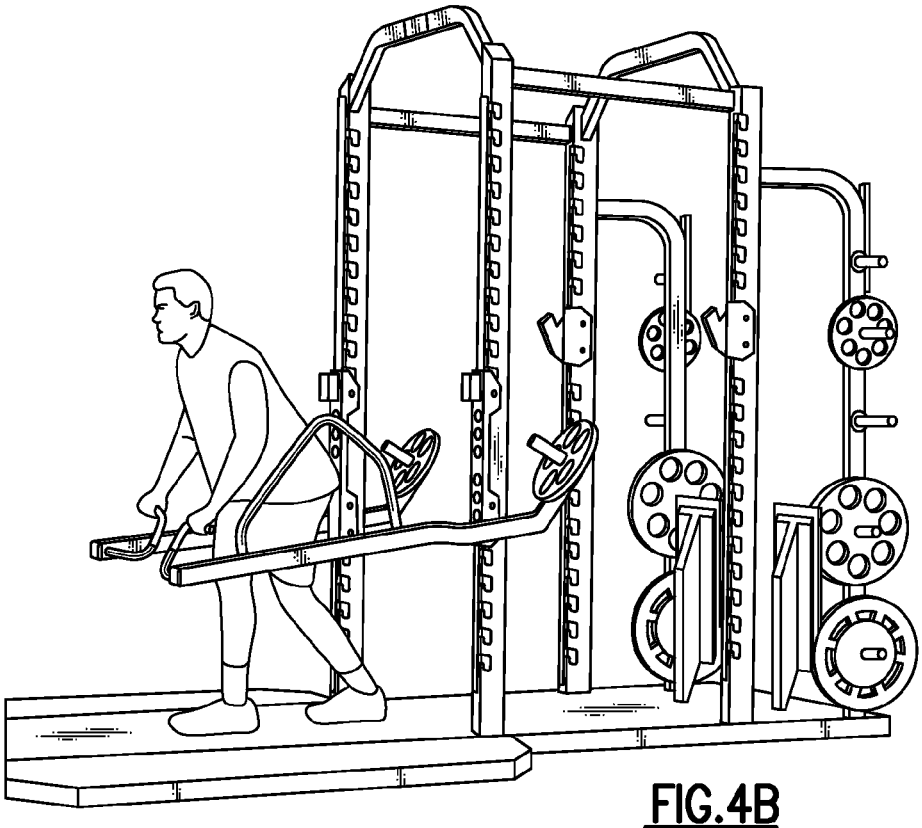
FIG. 4B is an example view of the decline arm system in use.

The weight arm system 14 may include various arm systems such as an incline arm system 26 (FIG. 1A) or a decline arm system 28 (FIG. 1B). The incline arm system 26 typically permits exercises which develop legs, hips, chest, shoulder and arm muscles amongst other muscles (FIG. 4A) while the decline arm system 28 typically permits core exercises (FIG. 4B). It should be understood that such exercises are exemplarily only and that other exercises may be performed—all of which are beneficially improved through the omni directional movement facilitated by the omni directional pivot system 30 through which the weight arm system 14 are mounted. The omni directional pivot system 30 combines the improved neuromuscular development typical of free weights exercises within the controlled environment typical of a machine. It should be understood that although a particular frame arrangement is illustrated in the disclosed embodiment, other arrangements are also contemplated as within the scope of this disclosure.

Figure 5A:
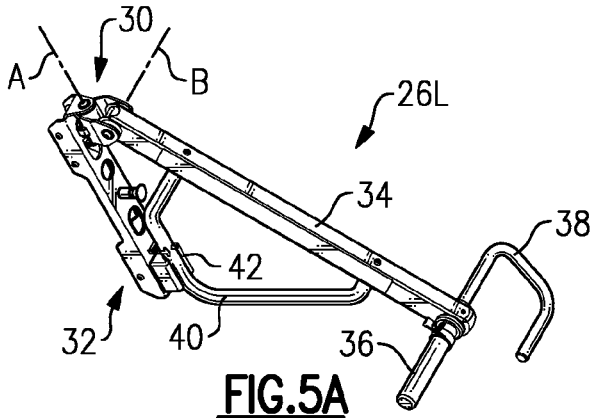
FIG. 5A is a perspective view of an incline arm system.

Referring to FIG. 5A, a left hand incline arm system 26L generally includes a bracket assembly 32, a weight arm 34, a weight horn 36, a handle 38 and a stop 40. The weight arm 34 may be of various configurations depending upon the desired exercises which are to be performed therewith. For example, a left hand decline arm system 28L (FIG. 5B) includes a weight arm 34D which locates the weight horn 36D and the handle 38D at generally opposite ends as compared to the incline arm system 26 which locates the weight horn 36 and handle 38 generally toward one end. It should be understood that although left arms are disclosed in the illustrated embodiment right arms (FIGS. 1A, 1B, 2A, 2B) are likewise constructed.

Figure 6B:
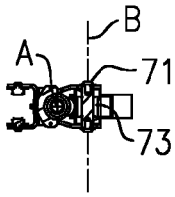
FIG. 6B is a top view of the incline arm system illustrated in FIG. 5A
Figure 6A:
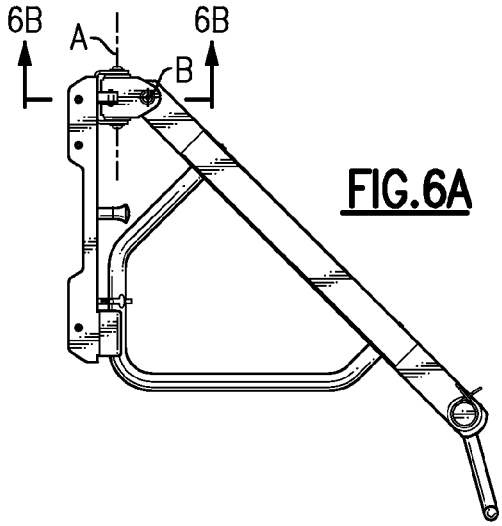
FIG. 6A is a side view of the incline arm illustrated in FIG. 5A.

The weight arm 34 is mounted to the bracket assembly 32 through the omni directional pivot system 30 which permits the weight arm 34 to pivot about a first axis A and a second axis B. The first axis A is defined along the length of the bracket assembly 32 while the second axis B is transverse thereto (also illustrated in FIGS. 6A and 6B). The combination of the movement about the first and second axis A, B relative bracket assembly 32 permits the novel omni directional movement (such as shown in FIG. 4A).

The stop 40 can be a tubular structure mounted to the weight arm 34 to support the weight arm 34 when in a rest position (illustrated in FIG. 4). The bracket assembly 32 also includes a bumper 42 which receives the stop 40 when the weight arm 34 is in the rest position.

Figure 5B:
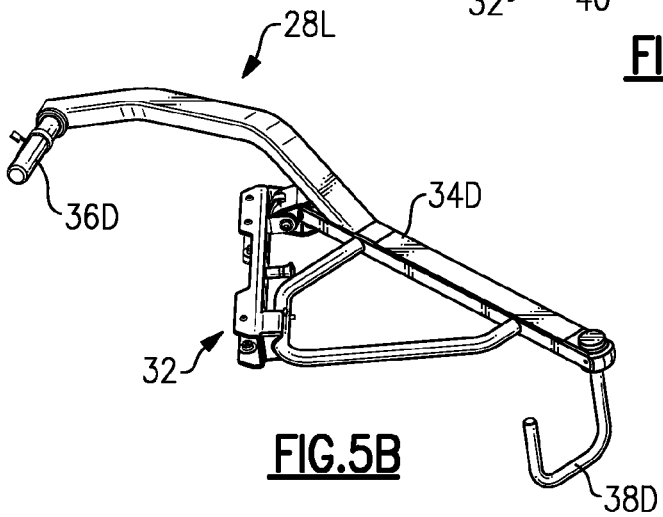
FIG. 5B is a perspective view of a decline arm system.
Figure 7A:
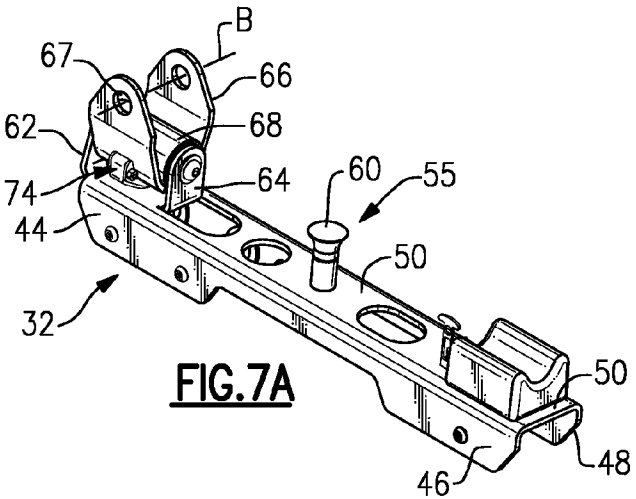
FIG. 7A is a perspective view of a bracket subassembly utilized for the incline arm system of FIG. 5A and the decline arm system of FIG. 5B.

Referring to FIG. 7A, the bracket assembly 32 may be common to both the incline arm system 26 (FIG. 5A) and the decline arm system 28 (FIG. 5B). The bracket assembly 32 includes a mount 44 which is generally U-shaped in cross-section. The mount 44 includes a first mount plate 46 opposed to and generally parallel with a second mount plate 48. The mount plates 46, 48 extend generally perpendicularly from a central mount plate 50 to form the generally U-shape. Preferably, the mount 44 is manufactured from a single, integral U-channel member.

Figure 7E:
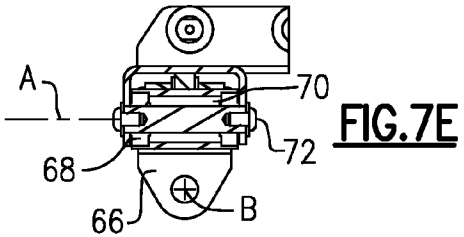
FIG. 7E is a sectional view of the pivot assembly of FIG. 7D taken along line 7E-7E.
Figure 7D:
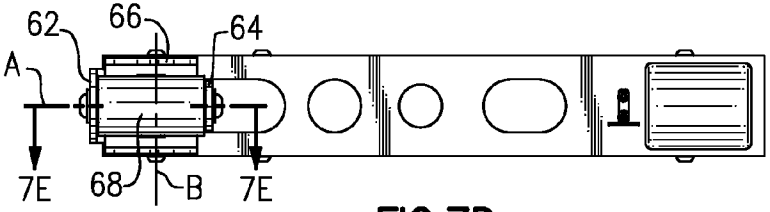
FIG. 7D is a front view of the bracket subassembly illustrated in FIG. 7A.
Figure 7C:
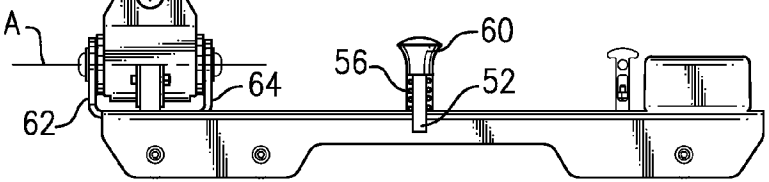
FIG. 7C is a side view of the bracket subassembly illustrated in FIG. 7A.
Figure 7B:
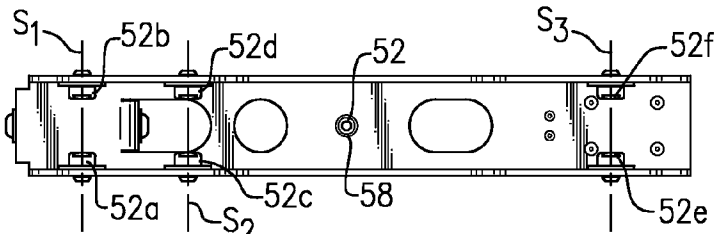
FIG. 7B is a rear view of the bracket subassembly illustrated in FIG. 7A.

A multitude of mount studs 52 (six shown; FIG. 7B) extend from an inner surface of the mount plates 46, 48 to engage the openings O (FIG. 2). The first stud 52*a* extends from the first mount plate 46 and is directly opposed to a second stud 52*b* which extends from an inner surface of the second mount plate 48 along a common axis S1. Likewise, the third stud 52*c* and the fourth stud 52*d* are located along a common axis S2 while the fifth stud 52*e* and the sixth stud 52*f* are located along a common axis S3. The axes S1, S2, S3 are spaced to correspond with the distance between the openings O (FIG. 1A). The studs 50*a*-50*f* are relatively significant solid members which mount through the mount plates 46, 48 with fasteners or the like.

A release knob assembly 55 is mounted to the central mount plate 50 such that a biased latch member 52 extends therethrough. The latch member 52 can include a pin which is biased by a spring 56 (FIG. 7C) or the like such that the latch member 54 extends through a latch aperture 58 (FIG. 7B) within the central mount plate 50 to engage the lock opening 24 (FIG. 2). The release knob assembly 55 is actuated by pulling a knob 60 to retract the latch member 52 toward and at least partially through the central mount plate 50 over the bias of the spring 56.

The omni directional pivot system 30 can be formed directly from the central mount plate 50. That is, a first mount arm 62 and a second mount arm 64 are cut out of bent away from the central mount plate 50 to provide an exceedingly robust structure.

An arm attachment mount 66 can be welded to a pivot pin 68 (also illustrated in FIG. 7D) which is mounted between the arms 62, 64. The arm attachment mount 66 includes apertures 67 which receive fasteners 72 such as bolts to pivotally attach the weight arm for pivotal movement about an arm pin 73 which defines axis B (also shown in FIGS. 6B and 7E). The pivot pin 68 includes a cylindrical bearing 70 (FIG. 7E) attached to the arms 62, 64 with fasteners 72 to define the axis A. The arm attachment mount 66 includes a centering device 74 such as a resilient pivot bumper which assists in centering the weight arm 34 but does not restrict pivotal movement. The centering device may provide at least some force feedback to the user.

In use, a desired arm system is selectively attached to a desired position along the weight bar frame rack 12 by locating the studs 52*a*-52*f* adjacent to openings O at a desired height. The bracket assembly 32 is pushed toward the upright frame member 16 such that the studs 52*a*-52*f* are located into the first opening portions O' (FIG. 2). The studs 52*a*-52*f* are then guided downward by the second opening portion O". Concurrent therewith, the latch member 54 is pushed at least partially through the central mount plate 50 over the bias of the spring 56 by interaction with the front face 18 of the upright frame member 16. As the studs 52*a*-52*f* slide down toward the bottom of the second opening portions O" the latch member 54 encounters an adjacent lock opening 24. When the studs 52*a*-52*f* reach the bottom of the second opening portions O", the latch member 54 is biased into the lock opening 24 by the spring 56. The bracket assembly 32 is thereby securely locked into place. Notably, the bracket assembly 32 is supported upon the studs 52*a*-52*f* which provide an exceedingly robust support structure. The interaction between latch member 54 and lock opening 24 only locks the bracket assembly 32 at a desired position.

To remove the bracket assembly 32, the knob 60 is retracted to overcome the bias of the spring 56 to retract the latch member 54 from the lock opening 24. The bracket assembly 32 is then lifted up and out of the openings O. As the openings O include corners with significantly large radii, the studs 52*a*-52*f* are readily guided thereby.

It should be understood that relative positional terms such as "forward," "aft," "upper," "lower," "above," "below," and the like are with reference to the normal operational attitude and should not be considered otherwise limiting.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A weightlifting system, comprising:

a weight bar frame rack having a first frame member that extends along a longitudinal axis, said first frame member having a front face, a first side face and a second side face, said first frame member having a multiple of opposed pairs of openings disposed along said longitudinal axis, wherein each of said multiple of opposed pairs of openings are generally L-shaped and include a first opening and a second opening; and a bracket assembly having a mount that includes a first mount plate and a second mount plate spaced from said first mount plate, wherein said mount straddles said first frame member such that each of said first mount plate and said second mount plate are engageable relative to at least two opposed pairs of openings of said multiple of opposed pairs of openings.

2. The weightlifting system as recited in claim 1, wherein said first opening includes a first first opening portion through said front face generally transverse to said longitudinal axis along a transverse opening axis and a second first opening portion through said first side face generally parallel to said longitudinal axis along a parallel opening axis.

3. The weightlifting system as recited in claim 2, wherein said second opening includes a first second opening portion through said front face generally transverse to said longitudinal axis along said transverse opening axis and a second second opening portion through said second side face generally parallel to said longitudinal axis along said parallel opening axis.

4. The weightlifting system as recited in claim 1, wherein said bracket assembly is engageable with said first openings and said second openings.

5. The weightlifting system as recited in claim 1, comprising a lock opening that is disposed through said front face at a horizontally staggered location relative to said first opening and said second opening.

6. The weightlifting system as recited in claim 1, comprising a lock opening disposed through said front face and between each of said multiple of opposed pairs of openings.

7. The weightlifting system as recited in claim 1, wherein said mount includes a generally U-shaped cross-section.

8. The weightlifting system as recited in claim 1, wherein said first mount plate and said second mount plate extend perpendicularly from a central mount plate of said mount.

9. The weightlifting system as recited in claim 1, comprising a plurality of mount studs that extend from an inner surface of each of said first mount plate and said second mount plate.

10. The weightlifting system as recited in claim 9, wherein said plurality of mount studs are engageable relative to at least a portion of said multiple of opposed pairs of openings.

11. The weightlifting system as recited in claim 9, wherein a first stud of said plurality of mount studs extends from said first mount plate and a second stud of said plurality of mount studs extends from said second mount plate along a common axis.

12. The weightlifting system as recited in claim 1, wherein said second mount plate is opposed to and parallel with said first mount plate.

13. The weightlifting system as recited in claim 1, comprising a release knob assembly mounted to said mount and engageable relative to a portion of said first frame member.

14. A weightlifting system, comprising:

a weight bar frame rack having a first frame member that extends along a longitudinal axis, said first frame member having a front face, a first side face and a second side face, said first frame member having at least one opposed pair of openings disposed along said longitudinal axis, wherein each opening of said at least one opposed pair of openings is generally L-shaped; and a bracket assembly having a mount that straddles said first frame member to engage said at least one opposed pair of openings.

15. A weightlifting system, comprising:

a weight bar frame rack having a first frame member that extends along a longitudinal axis, said first frame member having a front face, a first side face and a second side face, said first frame member having a multiple of opposed pairs of openings disposed along said longitudinal axis, wherein each of said multiple of opposed pairs of openings are generally L-shaped and include a first opening and a second opening;

a bracket assembly having a mount that includes a first mount plate and a second mount plate spaced from said first mount plate, wherein each of said first mount plate and said second mount plate are engageable relative to at least two opposed pairs of openings of said multiple of opposed pairs of openings; and a release knob assembly mounted to said mount and engageable relative to a portion of said first frame member.

* * * * *